US011289818B2

(12) United States Patent
Deng et al.

(10) Patent No.: US 11,289,818 B2
(45) Date of Patent: Mar. 29, 2022

(54) RF LENS WITH DOPING MEDIUM

(71) Applicant: Huawei Technologies Co., Ltd., Shenzhen (CN)

(72) Inventors: Changshun Deng, Chengdu (CN); Hongyun Li, Chengdu (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/913,501

(22) Filed: Jun. 26, 2020

(65) Prior Publication Data

US 2020/0328524 A1 Oct. 15, 2020

Related U.S. Application Data

(63) Continuation of application No. PCT/CN2018/125780, filed on Dec. 29, 2018.

(30) Foreign Application Priority Data

Dec. 29, 2017 (CN) ..... PCT/CN2017/120215

(51) Int. Cl.

| | |
|---|---|
| ***H01Q 15/02*** | (2006.01) |
| ***H01Q 19/06*** | (2006.01) |
| ***H01Q 15/10*** | (2006.01) |
| ***H01Q 23/00*** | (2006.01) |
| *H01Q 3/36* | (2006.01) |

(52) U.S. Cl.

CPC ..... *H01Q 15/02* (2013.01); *H01Q 15/10* (2013.01); *H01Q 19/06* (2013.01); *H01Q 23/00* (2013.01); *H01Q 3/36* (2013.01)

(58) Field of Classification Search

CPC ..... H01Q 15/02; H01Q 19/06; H01Q 23/00; H01Q 15/08; H01Q 15/10; H01Q 3/36

See application file for complete search history.

(56) References Cited

U.S. PATENT DOCUMENTS

| | | | |
|---|---|---|---|
| 3,755,815 | A | 8/1973 | Stangel et al. |
| 4,333,082 | A | 6/1982 | Susman |
| 4,381,509 | A | 4/1983 | Rotman et al. |

(Continued)

FOREIGN PATENT DOCUMENTS

| | | | |
|---|---|---|---|
| CN | 1254448 | A | 5/2000 |
| CN | 102122762 | A | 7/2011 |

(Continued)

OTHER PUBLICATIONS

Maltsev, A. et al., "Highly Directional Steerable Antennas: High-Gain Antennas Supporting User Mobility or Beam Switching for Reconfigurable Backhauling," IEEE Vehicular Technology Magazine, Mar. 2016, pp. 32-39.

(Continued)

*Primary Examiner* — Andrea Lindgren Baltzell
*Assistant Examiner* — Yonchan J Kim
(74) *Attorney, Agent, or Firm* — Slater Matsil, LLP

(57) ABSTRACT

This application relates to a wireless apparatus, and in particular, to an apparatus that is capable of performing beam sweeping. The apparatus provided in embodiments of this application integrates a feed source that may transmit a wireless signal and a lens. The lens covers the feed source, and an inner surface and/or an outer surface of the lens are/is curved surfaces/a curved surface.

19 Claims, 13 Drawing Sheets

(56) References Cited

U.S. PATENT DOCUMENTS

| | | | | |
|---|---|---|---|---|
| 4,458,249 | A * | 7/1984 | Valentino | H01Q 25/008 343/754 |
| 6,195,058 | B1 | 2/2001 | Nakamura et al. | |
| 6,281,853 | B1 | 8/2001 | Caille et al. | |
| 6,822,612 | B2 | 11/2004 | Takimoto et al. | |
| 2004/0239576 | A1 | 12/2004 | Matsumoto et al. | |
| 2008/0238810 | A1* | 10/2008 | Winsor | H01Q 15/08 343/911 R |
| 2010/0026574 | A1* | 2/2010 | Pozgay | H01Q 3/36 342/371 |
| 2010/0079354 | A1 | 4/2010 | Lam et al. | |
| 2012/0274525 | A1 | 11/2012 | Lam et al. | |
| 2016/0268682 | A1 | 9/2016 | Linnenbrink | |

FOREIGN PATENT DOCUMENTS

| | | | |
|---|---|---|---|
| CN | 102508242 | A | 6/2012 |
| CN | 103066397 | A | 4/2013 |
| CN | 103296476 | A | 9/2013 |
| CN | 104409849 | A | 3/2015 |
| CN | 105470660 | A | 4/2016 |
| CN | 105742824 | A | 7/2016 |
| CN | 106663876 | A | 5/2017 |
| CN | 107369914 | A | 11/2017 |
| CN | 107369915 | A | 11/2017 |
| CN | 107508044 | A | 12/2017 |
| EP | 1976062 | A1 | 10/2008 |
| JP | 2011099715 | A | 5/2011 |

OTHER PUBLICATIONS

Costa, J.R. et al., "Compact Beam-Steerable Lens Antenna for 60-GHz Wireless Communications," IEEE Transactions on Antennas and Propagation, vol. 57, No. 10, Oct. 2009, pp. 2926-2933.

Schoenlinner, B. et al.,"Wide-Scan Spherical-Lens Antennas for Automotive Radars", IEEE Transactions on Microwave Theory and Techniques, vol. 50, No. 9, Sep. 2002, pp. 2166-2175.

Laikin, M., "Lens Design", 4th Edition, CRC Press, 2007 (Optical Lens), 497 pages.

Fernandes, C.A. et al., "Dielectric Lens Antennas," Handbook of Antenna Technologies, Springer, 2016, pp. 1001-1064.

Thornton, J. et al., "Modern Lens Antennas for Communications Engineering", IEEE Press, Copyright 2013 by Institute of Electrical and Electronics Engineers, 284 pages.

Bodnar, D.G., "Lens Antennas," Antenna Engineering Handbook, Fourth Edition,Chapter 18, Copyright 2007, The McGraw-Hill Companies, pp. 18-1-18-30.

Liu, L. et al., "Array-fed MMW Wide-angle Multi-beam lens", School of Electronic Engineering, University of Electronic Science and Technology of China (UESTC), Chengdu, Oct. 19, 2017, 3 pages, China Academic Journal Electronic Publishing House.

* cited by examiner

RF LENS WITH DOPING MEDIUM

CROSS-REFERENCE TO RELATED APPLICATIONS

This application is a continuation of International Application No. PCT/CN2018/125780, filed on Dec. 29, 2018, which claims priority to International Patent Application No. PCT/CN2017/120215, filed on Dec. 29, 2017. The disclosures of the aforementioned applications are hereby incorporated by reference in their entireties.

TECHNICAL FIELD

This application relates to a wireless apparatus, and in particular, to an apparatus that is capable of performing beam sweeping.

BACKGROUND

In some scenarios in which a wireless signal needs to be sent, for example, in a scenario in which wave speed sweeping is used, wide-angle beam sweeping and beamforming need to be performed to obtain sufficient signal coverage, signal stability, and signal strength, and implement fast beam tracking.

In the prior art, an antenna array including a plurality of panels may be used to implement the wide-angle beam sweeping and a good beamforming capability. However, due to introduction of a multi-panel array, a feeding structure in the solution is complex, chip costs are high, and assembling is difficult. Therefore, how to design a low-cost and high-integration apparatus to implement the wide-angle beam sweeping and the beamforming is of great research and commercial value.

SUMMARY

This application provides an apparatus, to implement a low-cost and high-integration wireless signal transmission apparatus. The apparatus can implement wide-angle beam sweeping and has a good beamforming capability.

According to one aspect, an embodiment of this application provides an apparatus, including a feed source and a lens, where the lens covers the feed source, and an inner surface and/or an outer surface of the lens are/is curved surfaces/a curved surface, where the feed source is configured to provide a first beam. The lens is configured to respond to the first beam and generate a second beam.

In a possible design, a beam sweeping angle of the second beam is greater than a beam sweeping angle of the first beam, and/or a gain of the second beam is different from a gain of the first beam.

In a possible design, a thickness of the lens increases with an increase in a zenith angle of the lens, and the zenith angle is an angle between the lens and a normal line of a plane on which the feed source is located.

In a possible design, a body of the lens includes a doping medium. Optionally, doping densities of the doping medium at different positions of the lens are different. Optionally, the doping densities of the doping medium decrease with the increase in the zenith angle of the lens, and the zenith angle is the angle between the lens and the normal line of the plane on which the feed source is located.

In a possible design, at least one of a radian of the inner surface of the lens, a radian of the outer surface of the lens, and the thickness of the lens is determined based on the beam sweeping angle of the first beam and the beam sweeping angle of the second beam; and/or the at least one of the radian of the inner surface of the lens, the radian of the outer surface of the lens, and the thickness of the lens is determined based on the gain of the first beam and the gain of the second beam.

In a possible design, the medium doping density in the lens is determined based on a beam sweeping angle of the first beam and a beam sweeping angle of the second beam; and/or the medium doping density in the lens is determined based on the gain of the first beam and the gain of the second beam.

In a possible design, a medium layer is disposed on the inner surface and/or the outer surface of the lens. Optionally, a dielectric constant of the lens is $\varepsilon 1$, and a dielectric constant of the medium layer is $\varepsilon 2$, where $\varepsilon 2=\sqrt{\varepsilon 1}$, and a thickness of the medium layer is a quarter of a medium wavelength of $\varepsilon 2$.

In a possible design, a structure layer is disposed on the inner surface and/or the outer surface of the lens. Optionally, a dielectric constant of a material of the lens is $\varepsilon 1$, and a dielectric constant of the structure layer is $\varepsilon 2$, where $\varepsilon 2=\sqrt{\varepsilon 1}$, and a thickness of the structure layer is a quarter of a medium wavelength of $\varepsilon 2$. Optionally, a hole is disposed on the structure layer. Optionally, a depth of the hole is less than or equal to the quarter of the medium wavelength of $\varepsilon 2$. Optionally, at least two holes are disposed on the structure layer, and a distance between two adjacently disposed holes in the at least two holes is less than or equal to a half of the medium wavelength of $\varepsilon 2$.

In a possible design, a hole is disposed on the inner surface and/or the outer surface of the lens. Optionally, a depth of the hole is less than or equal to a quarter of a medium wavelength of $\varepsilon 2$, where $\varepsilon 2=\sqrt{\varepsilon 1}$, and $\varepsilon 1$ is a dielectric constant of a material of the lens. Optionally, when at least two holes are disposed on the inner surface of the lens and/or at least two holes are disposed on the outer surface of the lens, a distance between two adjacently disposed holes is less than or equal to a half of the medium wavelength of $\varepsilon 2$, where $\varepsilon 2=\sqrt{\varepsilon 1}$, and $\varepsilon 1$ is the dielectric constant of the material of the lens.

In a possible design, a symmetric center of the feed source coincides with a symmetric center of the lens.

In a possible design, a shape of the lens is a quasi-rotational symmetric structure or a quasi-translational transformation structure.

In a possible design, the feed source includes an active electronically scanned array (AESA). Optionally, the active electronically scanned array includes an analog active electronically scanned array or a digital active electronically scanned array. Optionally, the active electronically scanned array includes an analog signal processing circuit, a digital signal processing circuit, a beam control circuit, a power module, and at least one antenna unit, and the analog signal processing circuit includes an analog signal sending circuit and an analog signal receiving circuit.

According to another aspect, an embodiment of this application provides a device. The device includes any apparatus in the foregoing aspect.

The apparatus provided in this application integrates a feed source that may transmit a wireless signal and a lens, so that the apparatus can implement wide-angle beam sweeping and has a good beamforming capability. Compared with the prior art, the apparatus provided in this application can provide the wide-angle beam sweeping and a good beamforming function, and in addition, has advantages such as high integration, a compact structure, easy mounting, and relatively low costs.

BRIEF DESCRIPTION OF THE DRAWINGS

The following briefly describes the accompanying drawings required for describing embodiments.

DETAILED DESCRIPTION OF ILLUSTRATIVE EMBODIMENTS

The following describes the technical solutions in embodiments of this application with reference to the accompanying drawings in the embodiments of this application.

In some scenarios in which a wireless signal is sent, wide-angle beam sweeping and beamforming functions need to be used. Especially in a scenario in which a high-frequency signal is used, for example, indoor wireless communication, cellular communication, wireless backhaul, radar warning, radar monitoring, vehicle-mounted radar monitoring, internet of vehicles communication, self-driving, and unmanned aerial vehicle detection that are performed by using a millimeter wave and a submillimeter wave, due to a requirement of the scenario and an attenuation characteristic of the high-frequency signal, to ensure a signal coverage area, signal stability, and signal strength, and implement fast beam tracking, the wide-angle beam sweeping and a good beamforming capability are particularly important.

Figure 1:
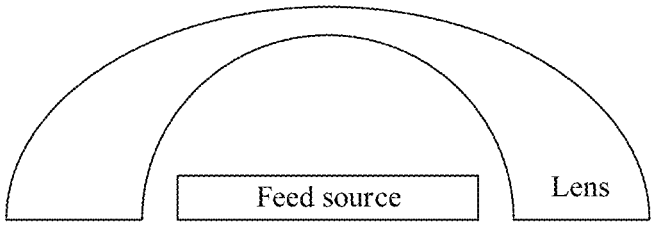
FIG. 1 is a schematic sectional view of an apparatus according to an embodiment of this application.

An embodiment of this application provides an apparatus. The apparatus may be configured to send a wireless signal. The apparatus includes a feed source and a lens. The lens covers the feed source. An inner surface and/or an outer surface of the lens are/is curved surfaces/a curved surface. The feed source is configured to provide a first beam. The lens is configured to: respond to the first beam and generate a second beam. FIG. 1 is a cross section chart of an apparatus according to an embodiment of this application. Because the inner surface and/or the outer surface of the lens are/is the curved surfaces/the curved surface, the second beam obtained after the first beam transmitted by the feed source undergoes a phase response of the lens may obtain a sweeping angle greater than that of the first beam, and a beam form of the first beam may be further adjusted by designing the inner surface and/or the outer surface and a thickness of the lens, to obtain a beamforming result and a beam gain that better meet a system requirement.

Optionally, the feed source in the foregoing apparatus is configured to provide a beam having a specific direction. The feed source includes at least one antenna unit, and may be an active device or a passive device. The active device may be an active system in various forms, including at least one antenna unit, and the passive device may be an antenna unit or an antenna array constituted by at least one antenna unit.

Specifically, the feed source in this embodiment of this application may be an active electronically scanned array, or a partial structure that includes an antenna unit and that is in an active electronically scanned array. The active electronically scanned array is used as the feed source of the apparatus in this application, so that integration of the apparatus can be improved, and the apparatus has a simple structure and is easy to install. In the following embodiments of this application, an example in which the feed source is an active electronically scanned array is used for description. When the feed source is an active device or a passive device in another form, a specific implementation of the lens in the embodiments of this application is not affected. For mounting manners and relative positions of the feed source and the lens, refer to a case in which the feed source is the active electronically scanned array.

An embodiment of this application provides an apparatus, including an active electronically scanned array (AESA) and a lens. The lens covers the active electronically scanned array, an inner surface and/or an outer surface of the lens are/is curved surfaces/a curved surface. The active electronically scanned array is used as a feed source and is configured to provide a first beam, and the lens is configured to: respond to the first beam and generate a second beam. The active electronically scanned array is used as the feed source to provide the first beam, and the lens adjusts the first beam to obtain the second beam having a wider beam sweeping angle, so that the entire apparatus can implement wide-angle beam sweeping and has a good beamforming capability. In addition, the active electronically scanned array uses only a one-panel or two-panel antenna array to provide the first beam having a specific beam direction, so that implementation costs of the entire apparatus are relatively low, integration is high, a structure is compact, engineering implementation difficulty and mounting difficulty are significantly reduced, and the apparatus has relatively high practical value and a wider application scenario.

Figure 2A:
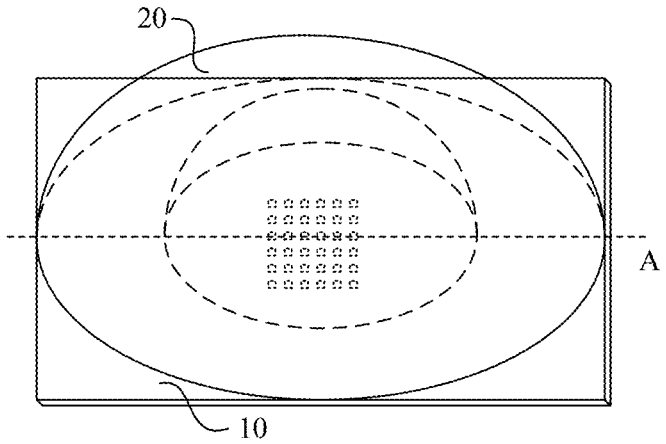
FIG. 2*a* and FIG. 2*b* are a three-dimensional perspective view and a cross section chart of another apparatus according to an embodiment of this application.
Figure 2B:
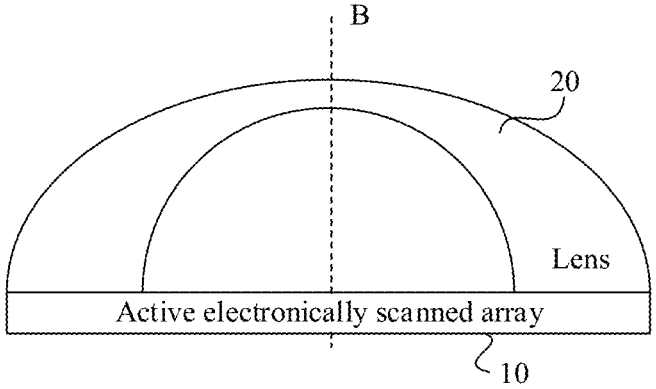

FIG. 2*a* is a three-dimensional perspective view of an apparatus according to an embodiment of this application. FIG. 2*b* is a cross section chart of the apparatus in FIG. 2*a* cut along a dashed line A. The apparatus includes an active electronically scanned array 10 and a lens 20, and the lens 20 covers the active electronically scanned array 10. The active electronically scanned array 10 may generate, through beam control, a first beam having a specific beam direction (that is, having a specific beam sweeping angle) and a specific beam width. An inner surface and/or an outer surface of the lens 20 are/is curved surfaces/a curved surface. The inner surface, the outer surface, and a lens medium generate a phase response for the first beam, to change a direction of the beam, for example, change a beam sweeping angle. By designing a radian of the inner surface and/or a radian of the outer surface of the lens 20, a degree of a change in a direction of an electromagnetic wave that is emitted into the lens 20 from a different position on the inner surface of the lens 20 may be further controlled, to further adjust beamforming of the first beam, for example, change a beam width of the first beam, so that a beamforming result and a beam gain of a second beam meet a system requirement.

A lens material, the lens medium, or a lens medium material described in this application is a medium material used to make the lens.

Optionally, as shown in FIG. 2*a* and FIG. 2*b*, the lens 20 may be mounted on the active electronically scanned array 10 through pasting or by using a fastener, and the entire apparatus is integrated, thereby further enhancing integration of the apparatus and reducing mounting difficulty.

Optionally, a material used for the lens 20 may be plastic, a resin material, or the like, and is not limited in this application.

Figure 3A:
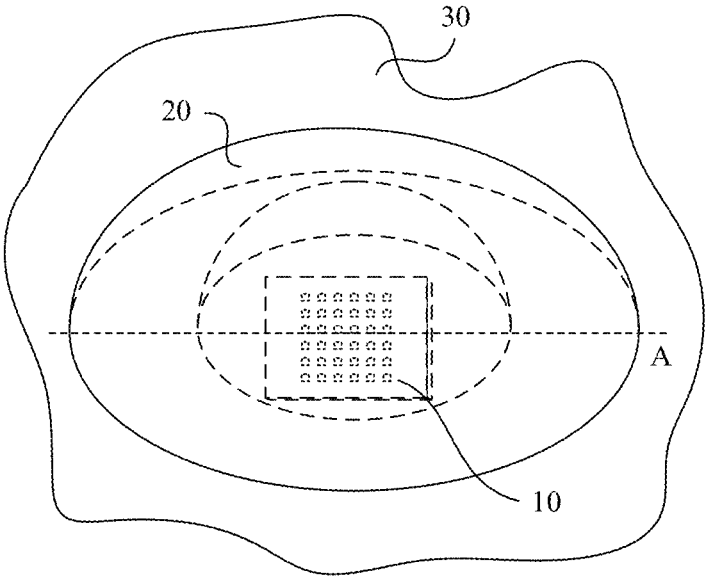
FIG. 3*a* and FIG. 3*b* are a three-dimensional perspective view and a cross section chart of still another apparatus according to an embodiment of this application.
Figure 3B:
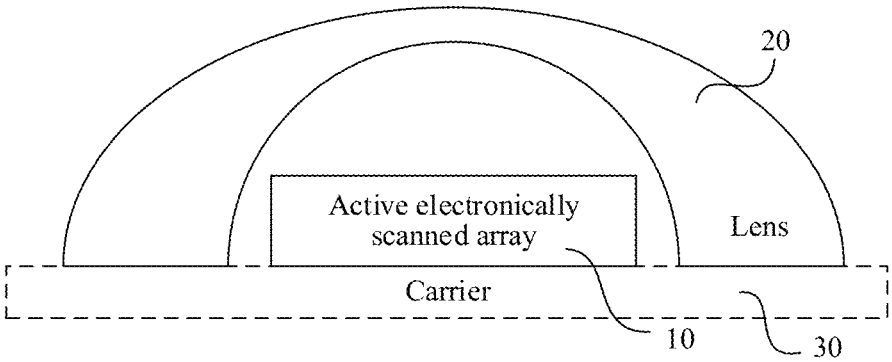

Optionally, the lens 20 and the active electronically scanned array 10 may be further separated, and are separately disposed on a carrier during use, as shown in FIG. 3*a* and FIG. 3*b*. The carrier may be any object that needs to use or dispose the apparatus, such as a wall, a hull, an aircraft, or a vehicle. FIG. 3*a* is a three-dimensional perspective view of another apparatus according to an embodiment of this application. FIG. 3*b* is a cross section chart of the apparatus in FIG. 3*a* cut along a dashed line A. To show a manner of installing the apparatus provided in this embodiment of this application, FIG. 3*a* and FIG. 3*b* further show a part in which the apparatus is installed on a carrier 30.

Relative positions of the active electronically scanned array 10 and the lens 20 may be set based on a specific requirement, and a specific shape and a specific size of the lens 20 need to be designed based only on a setting position and requirements for the beam sweeping angle and the beam gain. Optionally, a symmetric center of the active electronically scanned array 10 coincides with a symmetric center of the lens 20. In an implementation corresponding to FIG. 2*a* and FIG. 2*b* or FIG. 3*a* and FIG. 3*b*, the lens 20 is a quasi-rotational symmetric structure, and the symmetric center of the lens 20 coincides with the symmetric center of a shape of the active electronically scanned array 10. A rotational symmetric structure described in this application is a three-dimensional structure formed by rotating, by 180 degrees for a two-dimensional cross section, a straight line on which a symmetric axis of the cross section is located, and the quasi-rotational symmetric structure includes the foregoing rotational symmetric structure and a three-dimensional structure obtained by adjusting a part of the foregoing rotational symmetric structure. For example, in FIG. 2*b*, if a cross section of the lens 20 is rotated by 180 degrees along a symmetric axis B, a dome-shaped lens 20 whose inner surface and outer surface are both curved surfaces shown in FIG. 2*a* is obtained. It should be noted that, a position of the symmetric center, a position of the symmetric axis, whether the cross section of the lens is symmetric, and whether the shape of the active electronically scanned array is symmetric described in this application do not need to strictly meet a definition of the symmetric center or the symmetric axis in geometry, and an error or a work difference in a specific range may exist based on the definition in geometry, or the foregoing may be designed based on a specific requirement and the definition in geometry.

Optionally, a plane on which the electronically scanned array 10 is located is perpendicular to a plane on which a generatrix of the lens 20 is located.

Figure 4:
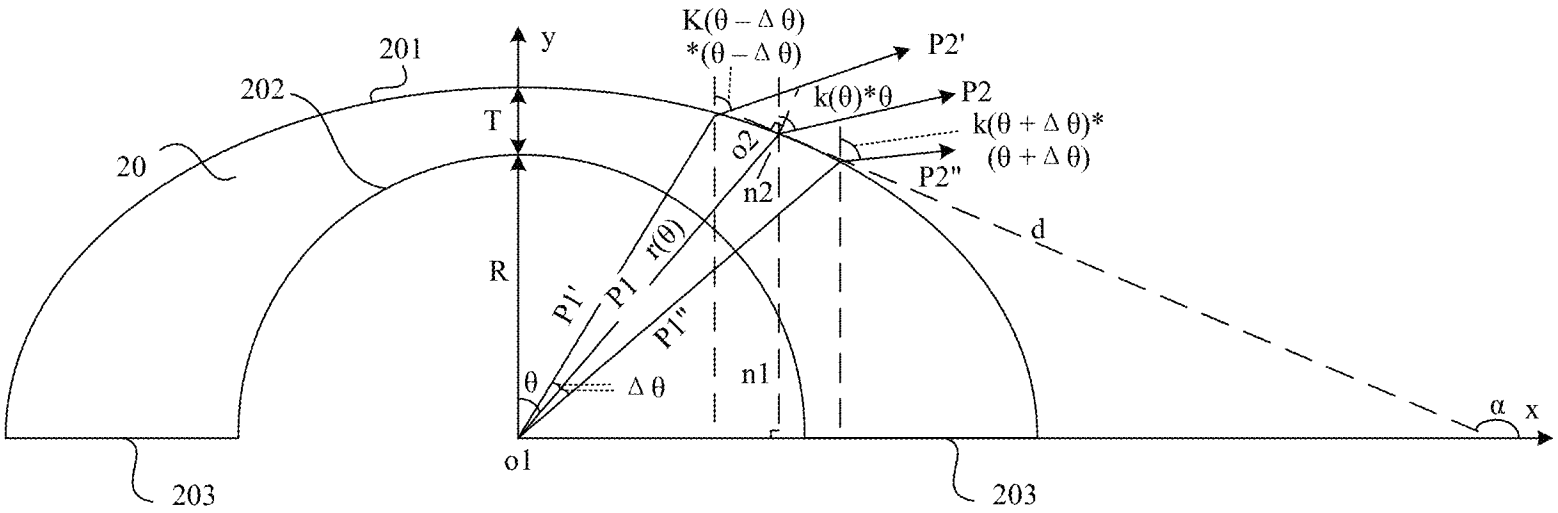
FIG. 4 is a design principle diagram of a lens in an apparatus according to an embodiment of this application.
Figure 5A:
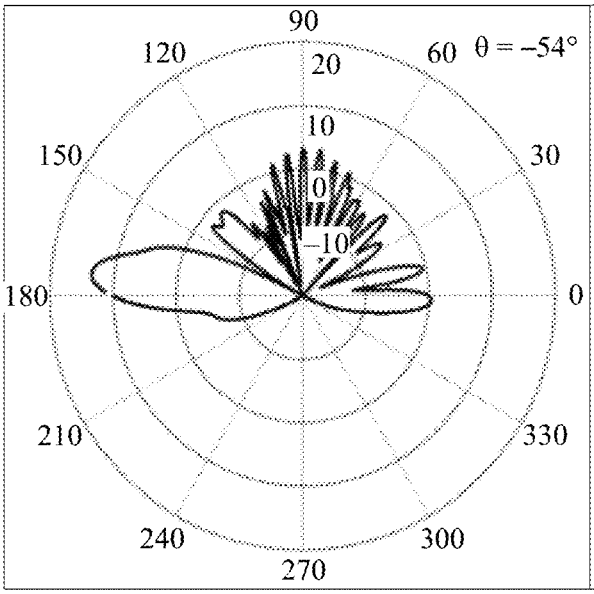
FIG. 5*a* to FIG. 5*e* are beam direction diagrams sent by an apparatus according to an embodiment of this application.
Figure 5B:
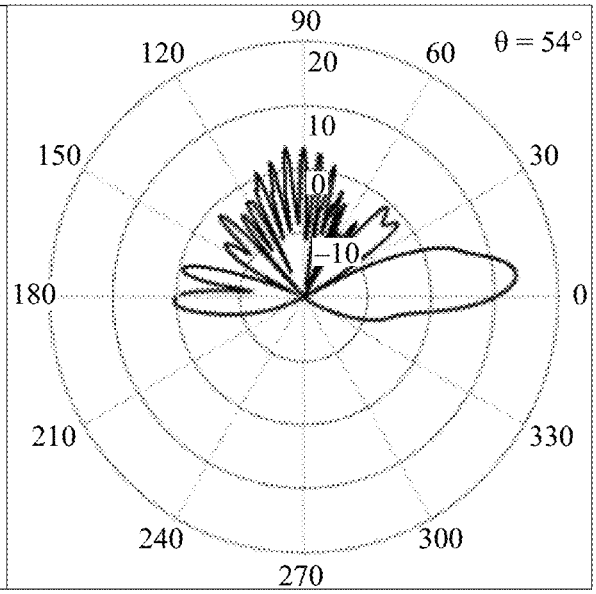
Figure 5C:
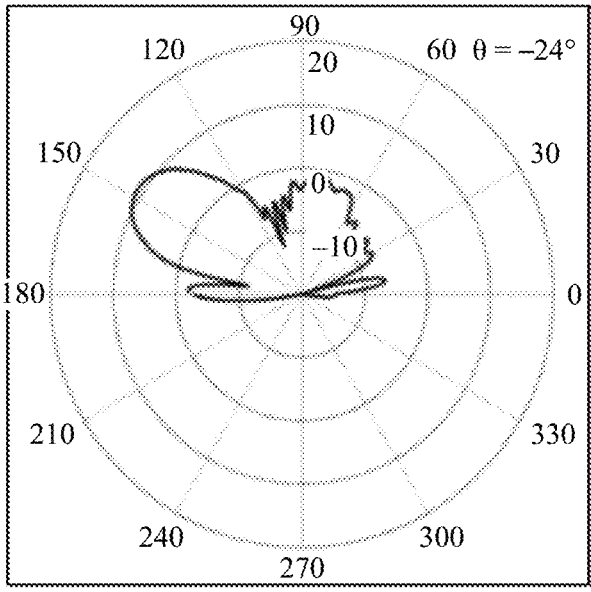
Figure 5D:
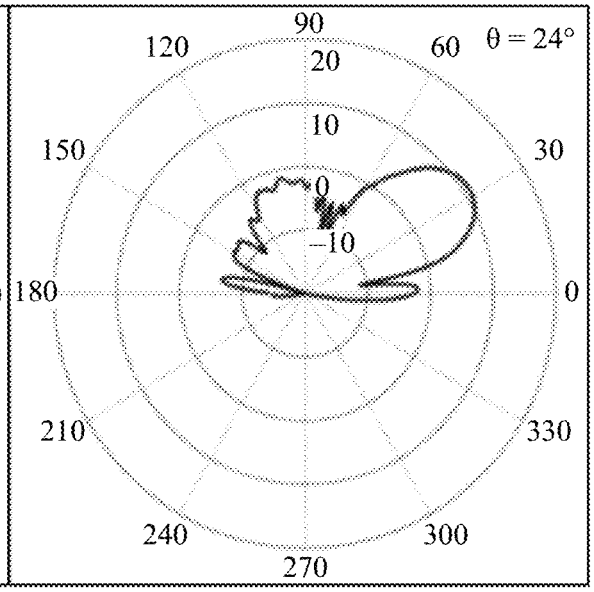
Figure 5E:
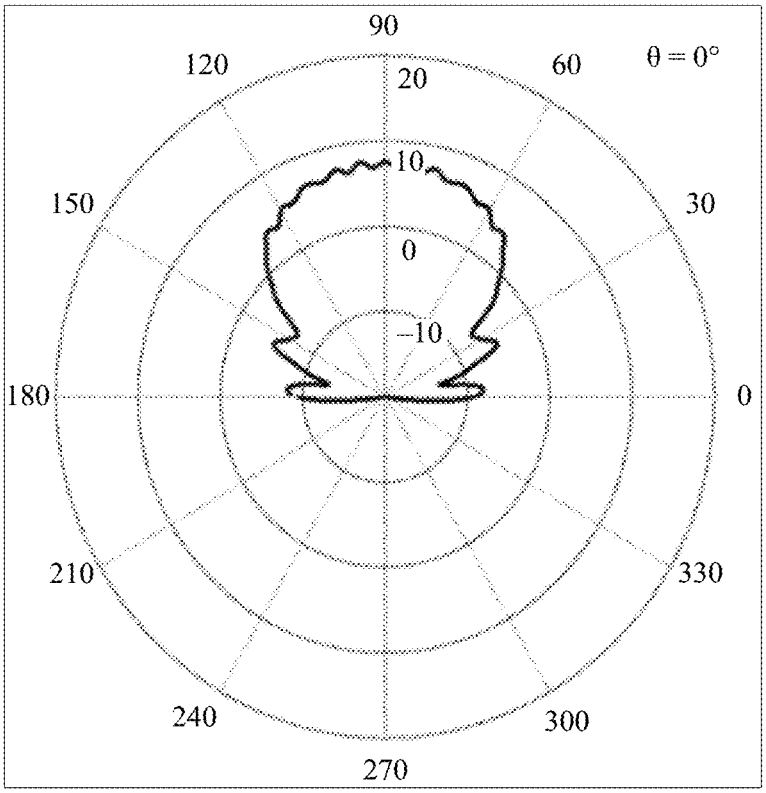

Optionally, a specific size of the lens 20 shown in FIG. 2*b* or FIG. 3*b*, for example, a curve equation of an inner surface cross section, a curve equation of an outer surface cross section, thicknesses of different positions, and other parameters may be determined based on a parameter of the first beam and/or a parameter of the second beam. The first beam from the active electronically scanned array 10 is emitted into the inner surface of the lens 20, and after a phase delay function of the lens 20, electromagnetic waves reaching points on the outer surface of the lens 20 have different phases, thereby changing a heading direction of an electromagnetic wave wavefront. Therefore, the electromagnetic waves are emitted from the outer surface of the lens 20 at a specific angle, to form the second beam. Different beam sweeping angles and different beam gain characteristics may be obtained by properly setting the curve equation of the inner surface cross section and/or the curve equation of the outer surface cross section. The beam "gain" described in this application means that when input power of an antenna or an antenna array for emitting a beam is the same as input power of an ideal isotropic radiation point source, and a ratio of radiation intensity in a $(\theta, \varphi)$ direction of the beam to radiation intensity of the ideal isotropic radiation point source is defined as the beam gain, where $(\theta, \varphi)$ is coordinates used to represent an angle in a spherical coordinate system, $\theta$ represents a zenith angle, and $\varphi$ represents an azimuth angle. In an example, at least one of the radian of the inner surface, the radian of the outer surface, and the thickness of the lens 20 is determined based on the beam sweeping angle of the first beam and a beam sweeping angle of the second beam, and/or the at least one of the radian of the inner surface, the radian of the outer surface, and the thickness of the lens 20 is determined based on a gain of the first beam and a gain of the second beam. The radian may be a curve equation of a particular segment of curve on an inner surface cross section curve or an outer surface cross section curve, or may be a curve equation of an entire inner surface cross section curve or an entire outer surface cross section curve. Specifically, a manner of designing the inner surface and the outer surface of the lens 20 is described with reference to FIG. 4. FIG. 4 is a cross section chart of the lens 20 in the apparatus shown in FIG. 2*a* or FIG. 3*a* cut along a generatrix of the lens 20. The generatrix of the lens 20 in FIG. 2*a* or FIG. 3*a* includes a cross section curve of an outer surface 201, a cross section curve of an inner surface 202, and a cross section line of a bottom surface 203 shown in FIG. 4.

The zenith angle described in this application is an angle between the lens and a normal line of a plane on which the feed source is located.

Without loss of generality, it is assumed that the cross section curve of the inner surface 202 is a semi-circular arc, and a design process of the lens 20 is described by using only design of a curve equation of the cross section curve of the outer surface 201 as an example. When the cross section curve of the inner surface 202 is not the semi-circular arc, or different parts in the cross section curve of the outer surface 201 or the cross section curve of the inner surface 202 need to be designed based on different requirements, a principle similar to the following design process may be used for design.

For the cross section chart of the lens 20 shown in FIG. 4, the cross section is axisymmetric relative to the y-axis, and the lens 20 is made of a medium with a refractive index of n. In the figure, 01 is an origin of a rectangular coordinate system, R is a radius of the cross section curve of the inner surface 202 of the lens 20, and T is a thickness of the lens 20 on the y-axis. Electromagnetic energy starts from 01, to form a first beam, where P1 represents a center direction of the first beam, and θ is an angle between P1 and a positive direction of the y-axis, and is defined as an angle at which the first beam is directed, that is, a beam sweeping angle of the first beam. P1' and P1" respectively represent directions of upper and lower edges of the first beam, and an angle (2×Δθ) between the upper and lower edges of the first beam is a first beam width, and r(θ) is a distance from an intersection point 02 of the outer surface of the lens 20 and P1 to 01. The cross section curve of the inner surface 202 is the semi-circular arc, and electromagnetic waves incident from various angles of 01 are vertically incident, no path deflection occurs. Therefore, only a deflection effect of the outer surface 201 on the electromagnetic waves needs to be considered, an effect of phase delays of electromagnetic waves reaching different positions on the outer surface 201 approximately meets the following formula:

$$\tan(\alpha) = \frac{r'(\theta)\cos(\theta) - r(\theta)\sin(\theta)}{r'(\theta)\sin(\theta) + r(\theta)\cos(\theta)} \tag{1}$$

$$\tan(\alpha + \theta) = \frac{\sin(k(\theta)\times\theta - \theta)}{n - \cos(k(\theta)\times\theta - \theta)} \tag{2}$$

$$r(\theta) = c(\theta)\times\sqrt[k(\theta)-1]{n - \cos(k(\theta)\times\theta - \theta)} \tag{3}$$

Particularly, when θ=θ°, r(θ)=R+T, and then:

$$c(\theta) = \frac{R+T}{\sqrt[k(\theta)-1]{n-1}} \tag{4}$$

With reference to FIG. 4, a dashed line n1 is a y-axis parallel line that passes through the point 02, d is a tangent line of the cross section curve of the outer surface 201 of the lens 20 at the point 02, α is an angle between the tangent line and a positive direction of the x-axis, n2 is a normal line of the tangent line d, and tan(α) is a slope of the tangent line d. An expression of the tan(α) is given by Formula (1), and in addition, Formula (2) may be derived from a refraction law formula and a geometric constraint of the lens. A polar coordinate expression r(θ) of the curve equation of the cross section curve of the outer surface 201 of the lens 20 may be obtained by eliminating a and solving a differential equation by using Formula (1) and Formula (2), that is, Formula (3), where c(θ) in Formula (4) is an undetermined coefficient used when the two equations (1) and (2) are solved, and the coefficient may be obtained by using a definite condition, for example, when θ=θ°, r(θ)=R+T. It can be learned from Formula (3) that r(θ) is a function of k(θ), and then the curve equation of the cross section curve of the outer surface 201 of the lens 20 may be obtained based on a requirement, for example, a specific value of k(θ). It should be noted that the foregoing derivation process is based on an ideal optical model. A real size of the lens 20, for example, the curve equation of the cross section curve of the outer surface 201 of the lens 20, may be adjusted based on the foregoing design or have a specific work difference.

Electromagnetic energy starts from of and passes through the lens 20 along the path P1, reaches the outer surface 201 of the lens 20, and is emitted along a path P2 at the point 02. An angle k(θ)×θ between P2 and the y-axis is a beam sweeping angle of a second beam, and k(θ) is a ratio of the beam sweeping angle of the second beam to the beam sweeping angle of the first beam, that is, an amplification multiple of the beam sweeping angle. When k(θ)>1, the beam sweeping angle is enlarged. When k(θ)<1, the beam sweeping angle is narrowed. A value of k(θ) may be determined based on a specific requirement. Electromagnetic energy simultaneously propagated separately along P1' and P1" (edges of the first beam) is propagated separately along P2' and P2" after an effect of the lens 20. An angle between P2' and the y-axis and an angle between P2" and the y-axis are respectively k(θ−Δθ)*(θ−Δθ) and k(θ+Δθ)*(θ+Δθ), and a difference between the two angles is a beam width of the second beam. Therefore, k(θ) determines the beam sweeping angle and the beam width of the second beam, and then determines a beam sweeping range and a beam gain of the second beam. A proper setting of k(θ) may implement different beam sweeping angle amplification and beam gain adjustment. For example, by setting k(θ) and a derivative of k(θ), a beam azimuth angle of 360° and a pitch angle of ±90° may be implemented, and in addition, the beam gain meets half-space beam sweeping of a quasi-cosecant squared feature (sec2θ), to ensure large-scale beam sweeping, signal strength stability of a beam in a sweeping process, and ensure system performance. For a value of k(θ) that meets a requirement, a generatrix design of the lens 20 may be further obtained, for example, the curve equation of the cross section curve of the outer surface 201 of the lens 20, to further obtain cross section design of the lens 20. Then, a designed cross section of the lens 20 is rotated by 180 degrees along a symmetric axis y, to obtain three-dimensional design of the dome-shaped lens 20 whose inner surface and outer surface are both curved surfaces shown in FIG. 2*a* or FIG. 3*a*.

In a specific example, for example, in the example corresponding to FIG. 4, a thickness of the lens 20 increases with an increase in a zenith angle. By changing thicknesses at different positions of the lens, phase delays of electromagnetic waves that are emitted from different positions on the inner surface of the lens may be adjusted. The thickness of the lens increases with the increase in the zenith angle, so that a phase delay of an electromagnetic wave passing through the lens may increase with the increase in the zenith angle, and a propagation direction of the second beam deviates towards a direction with a larger phase delay, thereby expanding a beam sweeping angle range of the second beam. Certainly, the thicknesses at the different positions of the lens 20 may be designed based on a requirement, and are not limited in this application.

In another specific example, the lens 20 may also be designed to have a uniform thickness. Equivalent dielectric constants at the different positions of the lens are adjusted in another manner, to adjust the beam sweeping angle and/or the beam width of the second beam, for example, doping some impurities inside a lens body. The equivalent dielectric constant described in this application is a dielectric constant obtained after a non-uniform medium is considered as a uniform medium.

FIG. 5*a* to FIG. 5*e* are diagrams of a direction of a second beam when an apparatus provided in an embodiment of this application is used and beam sweeping angles θ of a first beam are respectively −54°, 54°, −24°, 24°, and 0°. Specifically, it can be learned with reference to FIG. 5*a* to FIG. 5*e* and Table 1 that, the apparatus provided in this embodiment of this application may adjust a beam sweeping angle of the first beam, to obtain a larger beam sweeping angle, for example, may, extend to ±85°, the beam sweeping angle ±54° of the first beam provided by an active electronic sweeping array, to implement a larger beam sweeping range. In addition, beam forming results of different beam sweeping angles, for example, a beam width or a beam gain, may be adjusted based on a requirement. For example, when sweeping is performed at a large angle (for example, the beam sweeping angle of the second beam is ±85°), the beam gain increases by approximately 5.8 dB relative to that when the beam sweeping angle is 0°, and this is of great value in a scenario in which a signal needs to be stably received, for example, a scenario of lower half space coverage of a ceiling. A gain during θ=0° is used as a normalized reference point for the beam gain in Table 1.

TABLE 1

Example of beam radiation characteristics of the apparatus in this embodiment of this application

| Beam sweeping angle of a first beam | Beam sweeping angle of a second beam | Second beam gain (dB) | Second beam half-power width |
|---|---|---|---|
| −54° | −85° | 5.8 | 11° |
| 54° | 85° | 5.8 | 11° |
| −24° | −58° | 3.2 | 25° |
| 24° | 58° | 3.2 | 25° |
| 0° | 0° | 0 | 59° |

Considering that a reflection effect of an electromagnetic wave, that is, the first beam, on an inner surface or an outer surface of a lens 20 may adversely affect system performance, a matching layer may be further disposed on the inner surface and/or the outer surface of the lens 20 to reduce reflection of the lens 20 on energy of the first beam. The matching layer may be a medium layer, or may be a structure layer including a specific structure. The reflection of the electromagnetic wave on the inner surface or the outer surface of the lens 20 may be reduced by adjusting a dielectric constant and/or a thickness of the matching layer. Optionally, the dielectric constant of the matching layer is ε2, where $\varepsilon 2=\sqrt{\varepsilon 1}$, and ε1 is a dielectric constant of a material used for the lens 20. Optionally, the thickness of the matching layer is a quarter of a medium wavelength of ε2. The "medium wavelength" described in this application is defined as a distance that the electromagnetic wave advances in the medium each time the electromagnetic wave vibrates in the medium. In specific implementation, the dielectric constant of the matching layer may have a specific error based on $\sqrt{\varepsilon 1}$ or may be adjusted based on a requirement, that is, a value of the dielectric constant of the matching layer may be near to $\sqrt{\varepsilon 1}$. Similarly, the thickness of the matching layer may also be approximately a quarter of a medium wavelength of ε2. It should be noted that, when a generatrix of the lens 20 is designed, for example, a cross section curve equation of the inner surface or the outer surface is designed and a thickness of the lens 20 is designed, the matching layer is not included.

Figure 6:
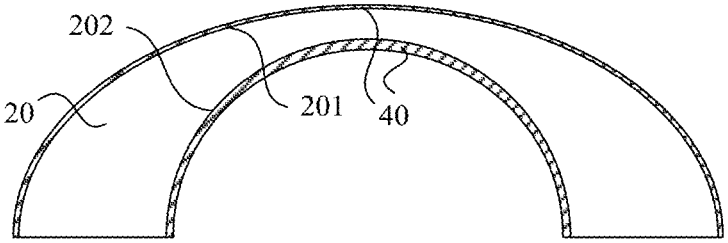
FIG. 6 is a cross section chart of a lens according to an embodiment of this application.

In an example, the matching layer is implemented by using the medium layer, and the medium layer is disposed on the inner surface and/or the outer surface of the lens 20. The medium layer may be a medium material with a uniform thickness, and is closely attached to the inner surface and/or the outer surface of the lens 20. Optionally, a dielectric constant of a material used for the medium layer is ε2. Optionally, a thickness of the medium layer is a quarter of a medium wavelength of ε2. As described above, in specific implementation, both the dielectric constant ε2 and the thickness may be adjusted based on a specific index requirement. Optionally, the medium layer may be a foam material, a resin material, a ceramic material, or the like, and is not limited in this application. FIG. 6 is a cross section chart of a lens 20 according to an embodiment of this application. A medium layer 40 is disposed on both an upper surface 201 and a lower surface 202 of the lens 20.

Figure 7A:
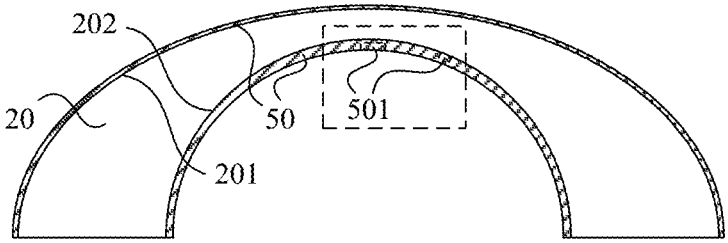
FIG. 7*a* and FIG. 7*b* are a cross section chart and a partially enlarged view of another lens according to an embodiment of this application.
Figure 7B:
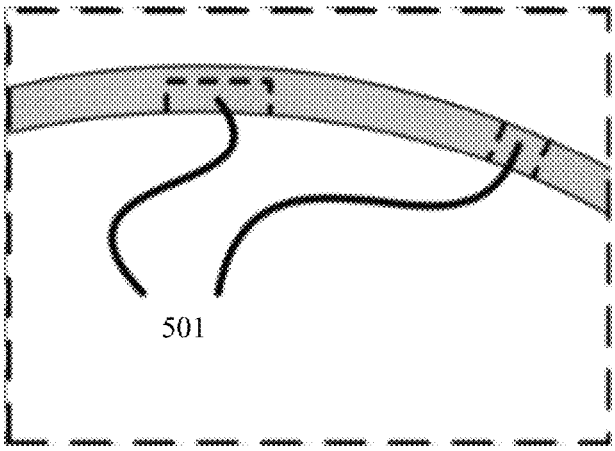

In another example, the matching layer is implemented by using a structure layer, and a structure layer is disposed on an inner surface and/or an outer surface of the lens 20. The structure layer may be a medium material including a specific design structure, such as a hole or a slot, and is disposed on an inner surface and/or an outer surface of the lens 20. A dielectric constant of a medium material used for the structure layer is not limited. The specific design structure, such as the hole or the slot, is disposed on the structure layer, and an equivalent dielectric constant of the entire structure layer is adjusted through air in the hole or the slot, so that reflection of an electromagnetic wave on the inner surface and/or the outer surface of the lens 20 can be reduced. Optionally, the equivalent dielectric constant is ε2. Optionally, a thickness of the structure layer is a quarter of a medium wavelength of ε2. As described above, in specific implementation, both the dielectric constant ε2 and the thickness may be adjusted based on a specific index requirement. Optionally, a depth of the hole or the slot disposed on the structure layer is less than or equal to the quarter of the medium wavelength of ε2, to adjust the equivalent dielectric constant. Optionally, when a plurality of holes or slots are disposed on the structure layer, a distance between adjacent holes or slots is less than or equal to a half of the medium wavelength of ε2, and the distance between the adjacent holes or slots may be a distance between centers of the adjacent holes or slots. The plurality of holes or slots may be evenly or unevenly arranged on the structure layer. A diameter, a depth, a shape (for example, a round hole or a square slot), a quantity, an arrangement shape, an arrangement density, and the like of the holes or slots may be adjusted based on a requirement for setting the equivalent dielectric constant, and are not limited in this application. FIG. 7*a* is a cross section chart of another lens 20 according to an embodiment of this application. A structure layer 50 is disposed on each of an upper surface 201 and a lower surface 202 of the lens 20, and a hole 501 is disposed on the structure layer 50. FIG. 7*b* is a partially enlarged view of a dashed-line box in FIG. 7*a*.

Figure 8A:
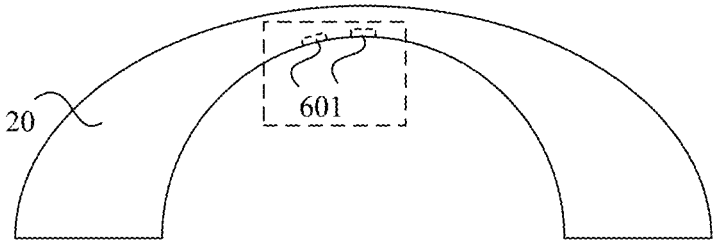
FIG. 8*a* and FIG. 8*b* are a cross section chart and a partially enlarged view of still another lens according to an embodiment of this application.
Figure 8B:
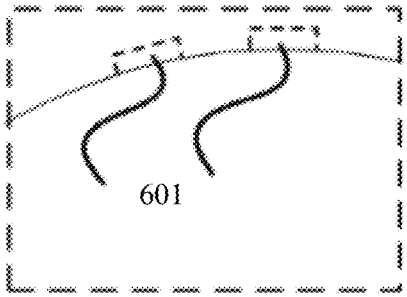

In another example, a function of a matching layer may be implemented by directly puncturing a hole or a slot on an inner surface and/or an outer surface of the lens. A specific depth of the hole or the slot, a distance between adjacent holes or slots, an arrangement manner of a plurality of holes or slots, and a diameter, a depth, a shape (for example, a round hole or a square slot), a quantity, an arrangement shape, an arrangement density, and the like of the hole or the slot are the same as a manner of disposing a hole or a slot on the foregoing structure layer. Details are not described herein again. The function of the matching layer is implemented by directly puncturing the hole on the lens, so that a production process and a production craft can be further simplified, and costs can be reduced. FIG. 8*a* is a cross section chart of another lens 20 according to an embodiment of this application. A hole 601 is disposed on a lower surface 202 of the lens 20. FIG. 8*b* is a partially enlarged view of a dashed-line box in FIG. 8*a*.

Optionally, when both an upper surface and the lower surface of the lens need to implement a function of the matching layer, the foregoing different methods for implementing the matching layer may be used in a combination manner. For example, the upper surface of the lens may be pasted with a medium layer, and the lower surface may implement the function of the matching layer by directly puncturing the hole on the lens. Alternatively, a hole may be directly punctured on the upper surface of the lens, and a structure layer is disposed on the lower surface, and the like.

Figure 9:
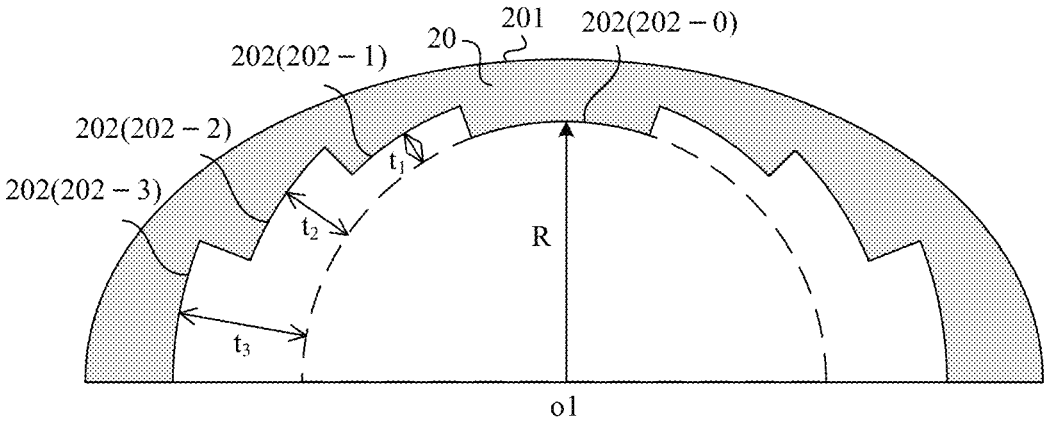
FIG. 9 is a cross section chart of yet another lens according to an embodiment of this application.

In another example, an inner surface of the lens 20 may alternatively be set to a stepped shape based on a requirement. For example, the stepped shape of the inner surface of the lens 20 is set based on the requirement such as a beam sweeping angle that is of a second beam and that needs to be obtained, or a beam width that is of the second beam and that needs to be obtained. FIG. 9 is a cross section chart of a lens 20 according to an embodiment of this application. For ease of description, a specific structure of the lens 20 in FIG. 9 is described below by using definitions of parameters of the lens 20 in FIG. 4. For the lens 20 shown in FIG. 9, an inner surface 202 (including 202-0, 202-1, 202-2, and 202-3) of the lens 20 is set to a stepped shape, for example, 202-1, 202-2, and 202-3. Optionally, with an increase in a zenith angle θ, a thickness of the lens 20 may be adjusted stepwise based on a radius R of a cross section curve of the inner surface 202. In a specific example, an R-based subtracted lens thickness $t_i$ (i=1, 2, 3, . . . m) may be set based on a medium wavelength of a lens material, and m is a quantity of steps on the inner surface of the lens 20. Specifically, a subtracted thickness may meet $t_i=(i-1)\times$medium wavelength of a lens material. Specifically, three annular steps are disposed on the inner surface 202 of the lens 20 shown in FIG. 9, R-based subtracted thicknesses are respectively t1, t2, and t3, and after thicknesses t1, t2, and t3 are subtracted, the thickness of the lens 20 increases on each step with the increase in the zenith angle. In a specific example, a thickness difference between a step and a step adjacent to the step may be set to a medium thickness of a lens material or a dielectric constant difference of the lens material used correspondingly if a phase delay difference $2\pi*z$ of an electromagnetic wave is caused when the electromagnetic wave passes through the lens material, and z is a positive integer. It may be understood that sizes such as a specific quantity of steps, a width of each step, and a thickness difference between steps may be set based on a specific requirement, and are not limited in this application. It may be understood that a change of the stepped thickness may be implemented on the inner surface of the lens 20, or may be implemented on an outer surface of the lens 20 by using a same principle, or may be implemented on both the inner surface and the outer surface of the lens 20.

Figure 10A:
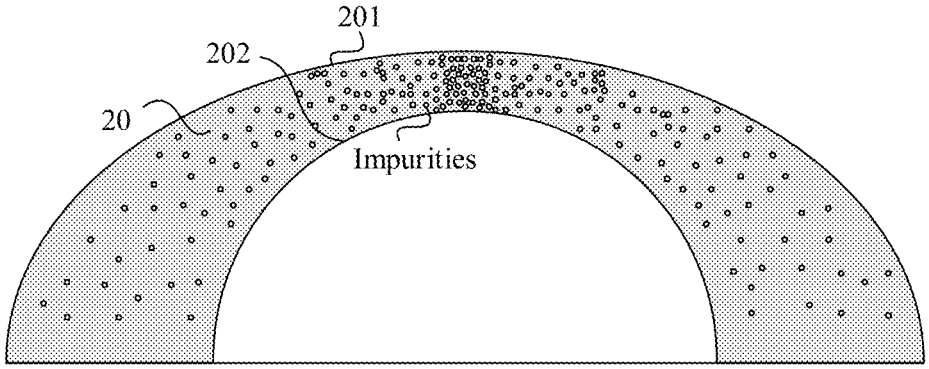
FIG. 10*a* and FIG. 10*b* are cross section charts of other two lenses according to an embodiment of this application.
Figure 10B:
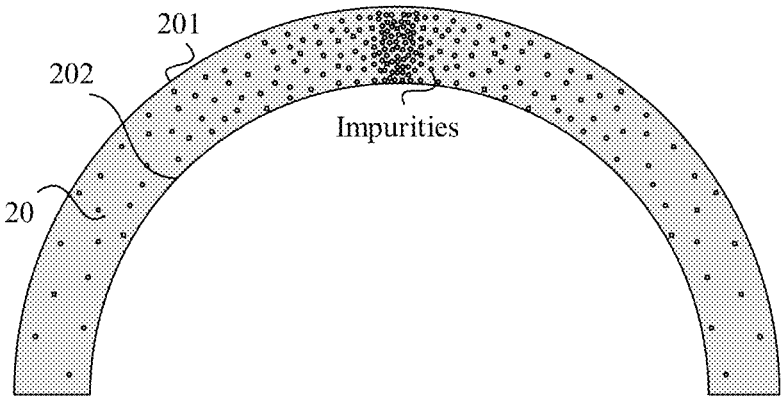

In another example, equivalent dielectric constants at different positions of the lens may be further adjusted by doping impurities into the lens material, to adjust phase delays of electromagnetic waves in the lens that are emitted from different positions on the inner surface of the lens, and further adjust a beam sweeping angle and/or a beam width of a second beam. Specifically, doping concentrations (also referred to as a doping density) of impurities at the different positions of the lens may be determined based on a requirement, to adjust the equivalent dielectric constants at the different positions of the lens, and further adjust the beam sweeping angle and/or the beam width of the second beam. In a specific example, a dielectric constant of impurities doped in the lens is less than a dielectric constant of the lens material, and then, a doping impurity concentration (or referred to as an impurity density) in the lens may be reduced from a symmetric axis of a lens cross section to two sides, so that an equivalent dielectric constant of the lens increases from a center to the two sides. In another specific example, a dielectric constant of impurities doped in the lens is greater than a dielectric constant of the lens material, and then, a doping impurity concentration (or referred to as an impurity density) in the lens may increase from a symmetric axis of a lens cross section to two sides, so that an equivalent dielectric constant of the lens increases from a center to the two sides. The doping impurity concentration may be changed uniformly or stepwise. Certainly, the equivalent dielectric constant of the lens may alternatively increase with the increase in the zenith angle by using different types of doping impurities or in another doping density adjustment manner. Optionally, an impurity doped in the lens material may be any medium or any material, may be granular, or may be another shape. The impurity or the medium is a medium material whose dielectric constant is different from that of a lens body material (that is, the lens material). In a specific example, the doping impurity or medium may be air (for example, a bubble), a ceramic particle, or the like. FIG. 10*a* and FIG. 10*b* are cross section charts of two lens according to an embodiment of this application. It can be learned from a cross section chart of a lens 20 in FIG. 10*a* that a thickness of the lens 20 increases with an increase in a zenith angle, and equivalent dielectric constants at different positions of the lens 20 are further adjusted by doping impurities. A thickness of the lens 20 in FIG. 10*b* remains unchanged, and equivalent dielectric constants at different positions of the lens 20 are adjusted by changing a doping concentration or a doping density of impurities. It may be understood that, when the equivalent dielectric constants of the lens 20 are adjusted by doping the impurities, a shape and a thickness of the lens 20 in this application may be more freely selected. For example, the thickness of the lens 20 may alternatively decreases with an increase in a zenith angle, or an irregular thickness or shape is used at the different positions of the lens.

It may be understood that specific implementations of the lens 20 provided in different accompanying drawings of this application may be used in a combination manner based on a requirement. The specific implementations are not described again.

Figure 11:
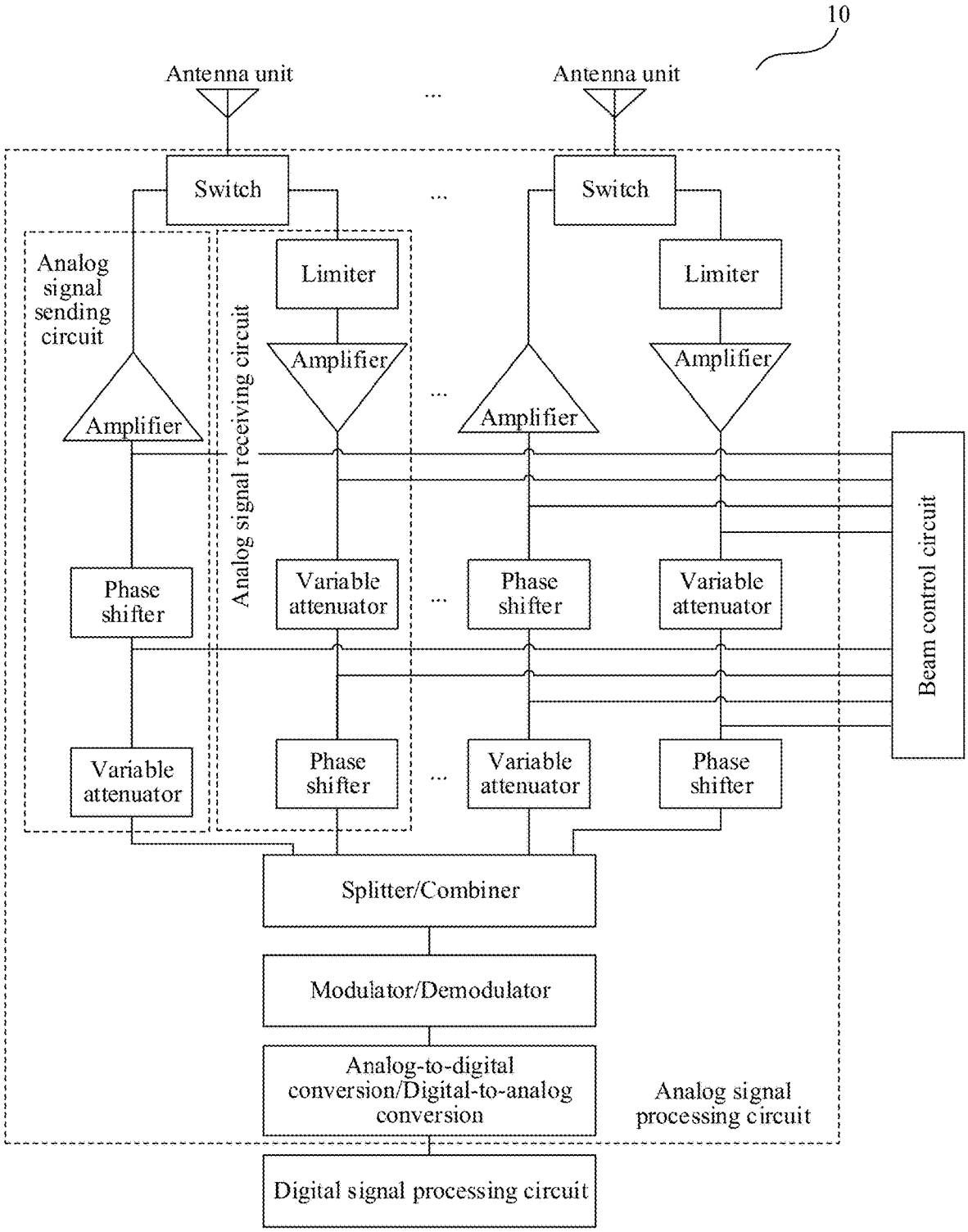
FIG. 11 is a structural block diagram of an active electronically scanned array according to an embodiment of this application.

Optionally, an active electronically scanned array 10 in this embodiment of this application may also be referred to as an active phased array, and may be an analog active electronically scanned array or a digital active electronically scanned array. FIG. 11 is a structural block diagram of an analog active electronically scanned array according to an embodiment of this application. An active electronically scanned array 10 may include an analog signal processing circuit, a digital signal processing circuit, a beam control circuit, a power module (not shown in FIG. 11), and at least one antenna unit, and the analog signal processing circuit includes an analog signal sending circuit and an analog signal receiving circuit. A to-be-sent signal undergoes the digital signal processing circuit, analog-to-digital conversion, modulation, and signal splitting, and then sent to the analog signal sending circuit. In the analog signal sending circuit, an amplitude is adjusted by a variable attenuator, a phase is adjusted by a phase shifter, and then the to-be-sent signal is amplified by an amplifier and transmitted by an antenna unit. The antenna unit receives a radio frequency signal from space and sends the radio frequency signal to the analog signal receiving circuit. In the analog signal receiving circuit, an analog signal is processed by a limiter, an amplifier, a variable attenuator, and a phase shifter and then sent to a combiner. After demodulation and analog-to-digital conversion, a digital signal is generated and sent to the digital signal processing circuit. The switch is configured to adjust a connection relationship between the antenna unit and the analog signal sending circuit and the analog signal receiving circuit. The variable attenuator and the phase shifter perform beamforming and beam sweeping angle adjustment on sent and received first beams by using the beam control circuit.

Figure 12A:
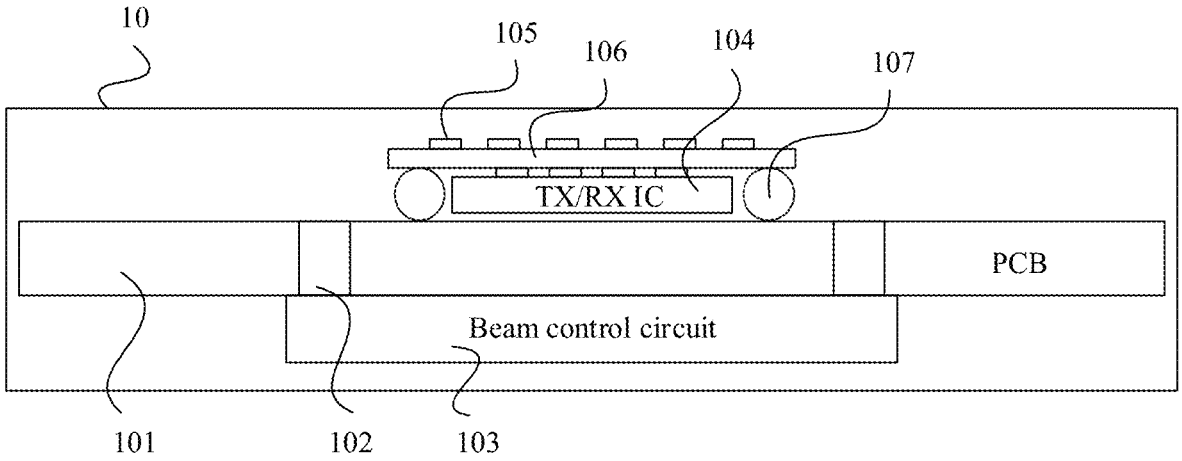
FIG. 12*a* to FIG. 12*d* are cross section charts of four active electronically scanned arrays according to an embodiment of this application.
Figure 12B:
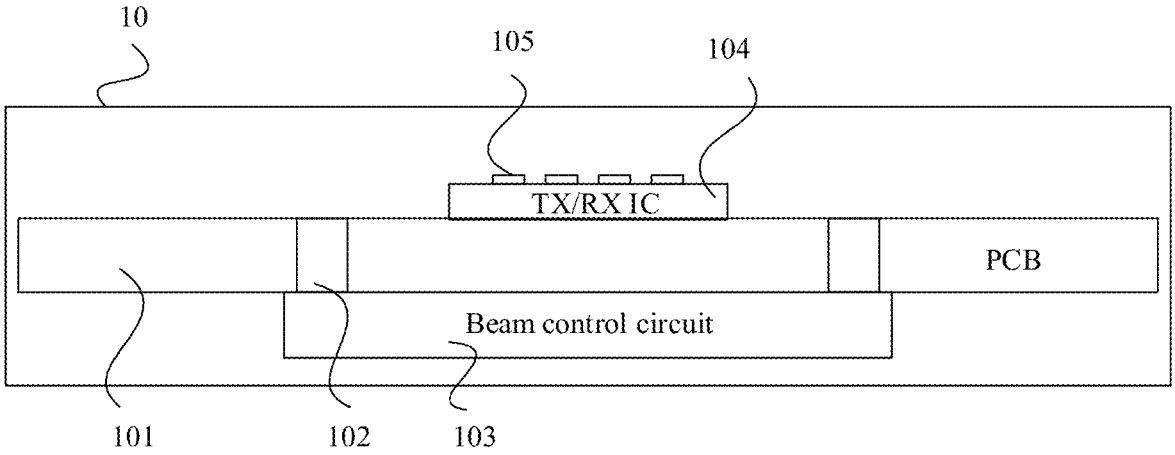
Figure 12C:
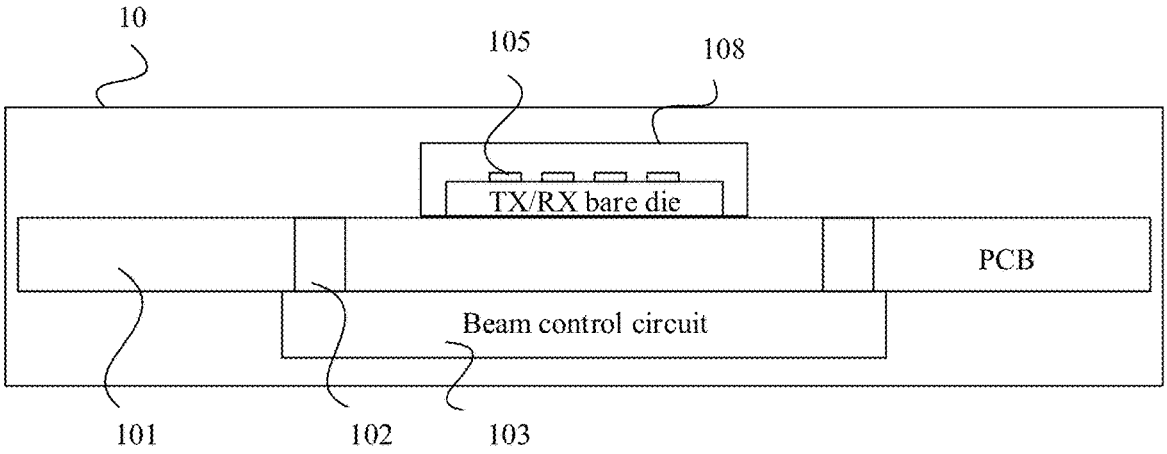
Figure 12D:
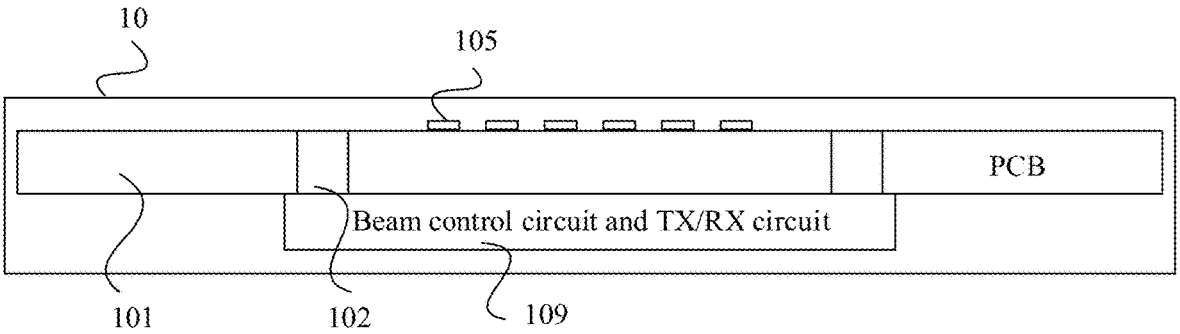

The active electronically scanned array 10 in this embodiment of this application may have different implementation forms or different appearance design. FIG. 12*a* to FIG. 12*d* are cross section charts of four possible active electronically scanned arrays. A printed circuit board (printed circuit board, PCB) 101 is configured to print or integrate a circuit structure required by an active electronically scanned array 10, and a through hole 102 on the PCB 101 is used to connect a circuit structure arranged on an upper surface of the PCB 101 and a circuit structure arranged on a lower surface of the PCB 101. A beam control circuit 103 may be printed on the lower surface of the PCB 101. In FIG. 12*a*, an analog signal sending circuit and an analog signal receiving circuit are integrated in an integrated circuit (integrated circuit, IC) chip 104 (denoted as a TX/RX IC below), and are arranged on the upper surface of the PCB 101. At least one antenna unit 105 may be integrated on an upper surface and/or a lower surface of a substrate 106 in a manner such as welding. The lower surface of the substrate 106 is connected to the TX/RX IC 104. The at least one antenna unit 105, the substrate 106, and the TX/RX IC 104 may be packaged as a whole, for example, ball grid array packaging (ball grid array packaging, BGA packaging) packaging is performed, and circuit structures on the PCB 101 circuit board are connected by using a pin (PIN) 107. A difference between FIG. 12*b* and FIG. 12*a* lies in that the at least one antenna unit 105 is directly integrated on a chip package outer surface of the TX/RX IC 104, so that a structure of the substrate 106 and the pin 107 are not required, thereby simplifying a circuit structure. A difference between FIG. 12C and FIG. 12*a* lies in that the at least one antenna unit 105 is directly packaged together with a bare die (denoted as a TX/RX bare die) for integrating the analog signal sending circuit and the analog signal receiving circuit, to form a chip 108, so that a structure of the substrate 106 and the pin 107 is not required, thereby simplifying a circuit structure. In FIG. 12*d*, the at least one antenna unit 105 is directly arranged on the upper surface of the PCB 101, the analog signal sending circuit, the analog signal receiving circuit (denoted as a TX/RX circuit), and the beam control circuit are arranged on the lower surface of the PCB 101, and the through hole 102 on the PCB 101 is used to connect a circuit structure arranged on the upper surface of the PCB 101 and a circuit structure arranged on the lower surface of the PCB 101, to form an integrated low-cross section structure, thereby further improving integration of an apparatus in this embodiment of this application. Optionally, the antenna unit 105 may be implemented in various different forms of antenna units, for example, a patch antenna, an antenna element, a slot antenna, or radiators of various shapes. This is not limited in this application.

Figure 13:
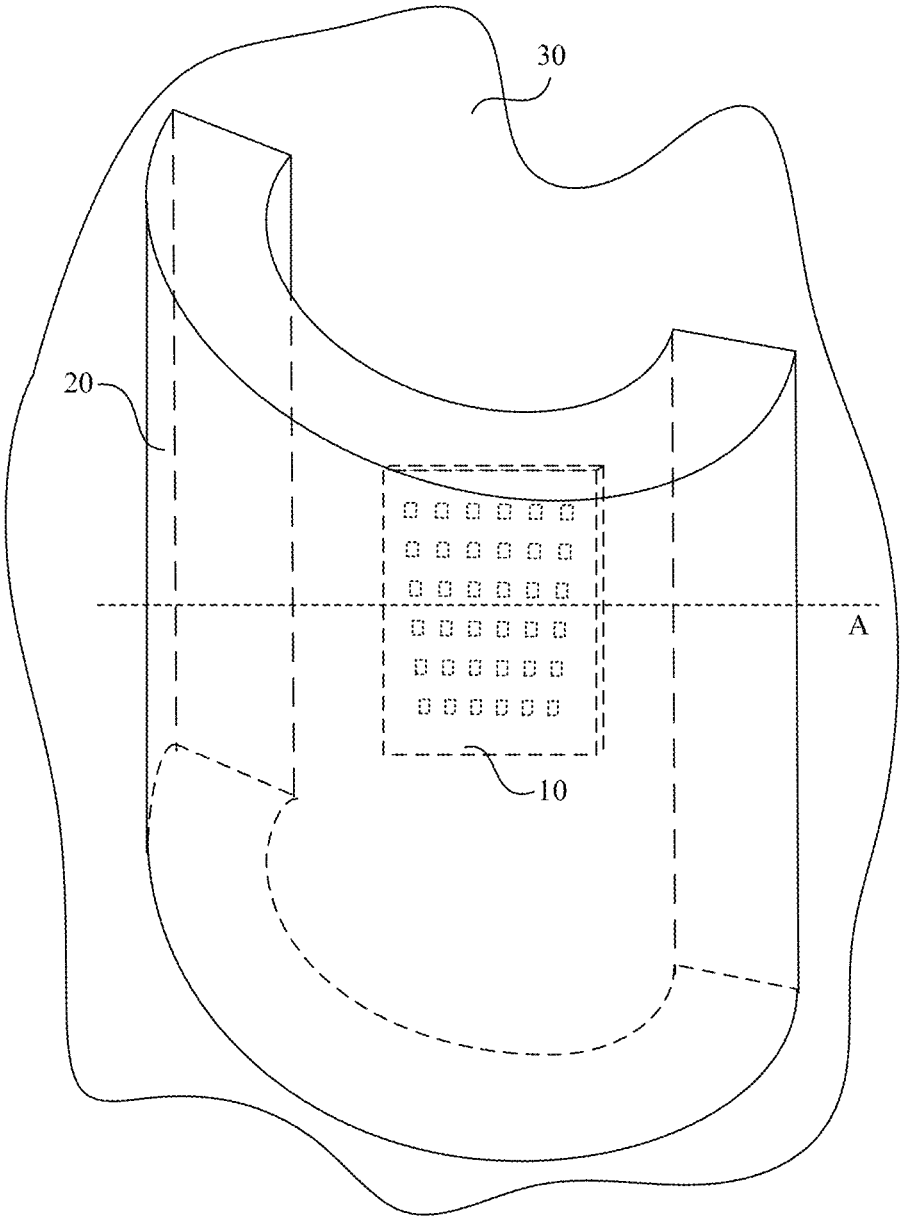
FIG. 13 is a three-dimensional perspective view of yet another apparatus according to an embodiment of this application.

FIG. 13 is a three-dimensional perspective view of yet another apparatus according to an embodiment of this application. The apparatus includes an active electronically scanned array 10 and a lens 20. The lens 20 covers the active electronically scanned array 10, and the active electronically scanned array 10 and the lens 20 are mounted on a carrier 30. A cross section chart of the apparatus shown in FIG. 13 is the same as that in FIG. 3*b*. A difference from the apparatus in FIG. 2*a* and FIG. 2*b* or FIG. 3*a* and FIG. 3*b* lies in that the lens 20 of the apparatus shown in FIG. 13 is a quasi-translational transformation structure. A translational transformation structure described in this application is a three-dimensional structure formed by translating a two-dimensional cross section chart along a normal line of a plane on which the cross section is located, and the quasi-translational transformation structure includes the foregoing translational transformation structure and a three-dimensional structure obtained by performing fine adjustment on the foregoing translational transformation structure. Specifically, in FIG. 13, the lens 20 is a half-cylindrical lens. Optionally, a projection center of the lens 20 on a mounting surface of the carrier 30 coincides with a symmetric center of the active electronically scanned array 10. Certainly, relative positions of the lens 20 and the active electronically scanned array 10 may also be set based on a requirement. Optionally, the lens 20 shown in FIG. 13 may alternatively be installed on the active electronically scanned array 10 as a whole and then installed on the carrier. This is similar to the apparatus shown in FIG. 2, and is not shown in the accompanying drawings herein again. Except that a shape of the lens 20 is different, a design principle and a solution of the apparatus shown in FIG. 13 are the same as a design principle and an implementation of the apparatus shown in FIG. 2*a* and FIG. 2*b* or FIG. 3*a* and FIG. 3*b*, and details are not described again.

Figure 14A:
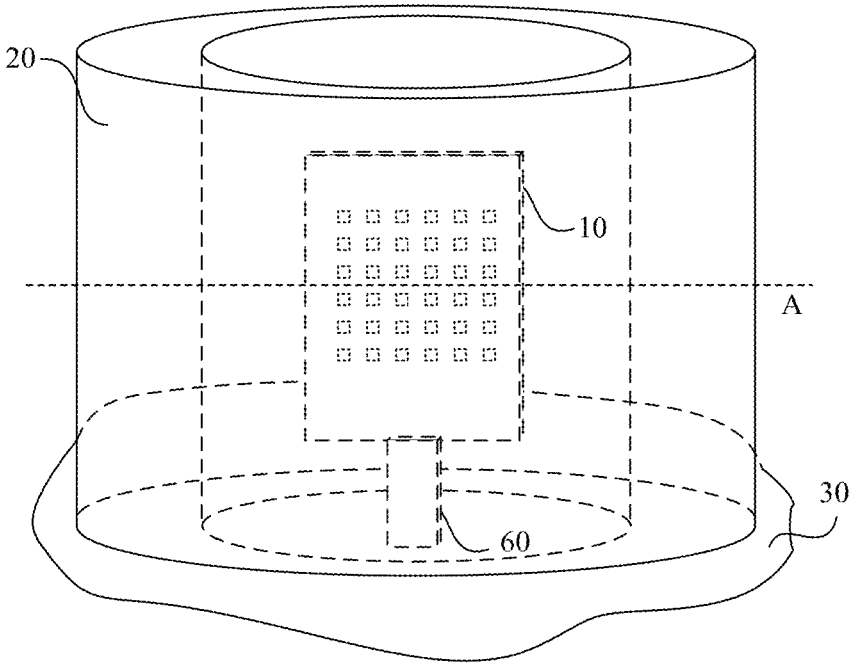
FIG. 14*a* and FIG. 14*b* are a three-dimensional perspective view and a cross section chart of still yet another apparatus according to an embodiment of this application.
Figure 14B:
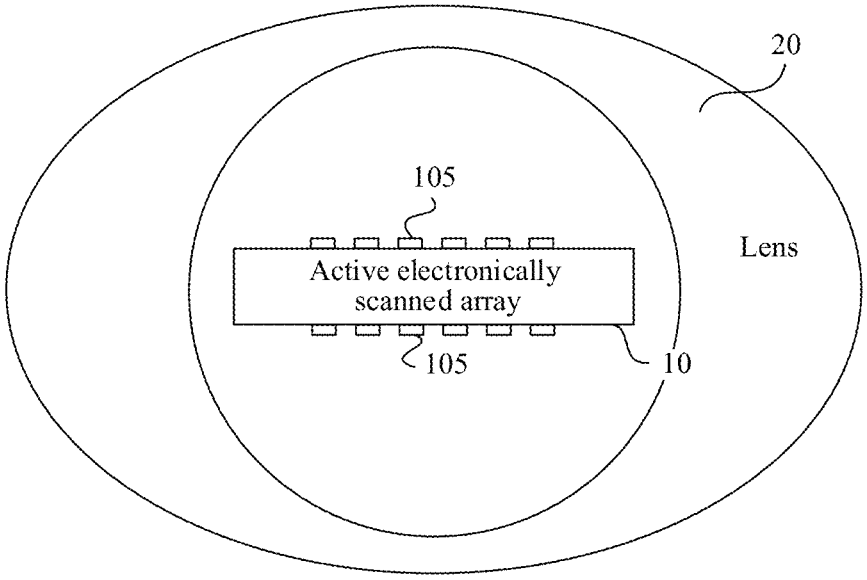

FIG. 14*a* is a three-dimensional perspective view of still yet another apparatus according to an embodiment of this application. FIG. 14*b* is a cross section chart of the apparatus shown in FIG. 14*a* cut along a dashed line A. The apparatus shown in FIG. 14*a* and FIG. 14*b* includes an active electronically scanned array 10 and a lens 20. The lens 20 covers the active electronically scanned array 10. The active electronically scanned array 10 is mounted on a carrier 30 by using a mounting kit 60, and the lens 20 is mounted on the carrier 30. The lens 20 of the apparatus shown in FIG. 14*a* and FIG. 14*b* also belongs to a quasi-translational transformation structure, and is specifically a cylindrical lens. During mounting, a projection center of the lens 20 on a mounting surface of the carrier 30 may coincide with a projection center of the active electronically scanned array 10 on the mounting surface of the carrier 30. Optionally, an antenna unit 105 may be disposed on both surfaces of the active electronically scanned array 10 shown in FIG. 14*b*. As shown in FIG. 14*b*, with reference to the cylindrical lens 20 shown in FIG. 14*a*, a beam sweeping range in larger space may be implemented. Except that a shape of the lens 20 is different, a design principle and a solution of the apparatus shown in FIG. 14*a* and FIG. 14*b* are the same as a design principle and an implementation of the apparatus shown in FIG. 3*a* and FIG. 3*b*, and details are not described again.

An embodiment of this application further provides a device. The device includes any apparatus provided in embodiments of this application. The device may be a terminal device, or may be a network device, or may be another device that needs to send a wireless signal or perform beam coverage, tracking, probe, warning, detection, or sweeping by using a wireless signal, for example, radar, a vehicle-mounted communications apparatus, or an unmanned aerial vehicle. This is not limited in this application. Specifically, the foregoing device provided in this embodiment of this application may be used in scenarios such as indoor lower half-space beam coverage, outdoor base station large-angle coverage, radar upper half-space warning, vehicle-mounted collision prevention, radar wide-angle sweeping, and unmanned aerial vehicle lower half-space beam sweeping probe or monitoring.

What is claimed is:

1. An apparatus, comprising:

a feed source; and a lens, wherein the lens covers the feed source, and wherein an inner surface of the lens or an outer surface of the lens is a curved surface;

wherein the feed source is configured to provide a first beam;

wherein the lens is configured to respond to the first beam and generate a second beam; and wherein a body of the lens comprises a doping medium having a first dielectric constant, the doping medium adjusted by doping impurities in the doping medium, wherein the doping impurities have a second dielectric constant that is different from the first dielectric constant and that adjust phase delays of electromagnetic waves in the lens emitted from different positions on the inner surface of the lens, and wherein the doping impurities are completely encapsulated by the doping medium.

2. The apparatus according to claim 1, wherein a beam sweeping angle of the second beam is greater than a beam sweeping angle of the first beam, or a gain of the second beam is different from a gain of the first beam.

3. The apparatus according to claim 1, wherein a thickness of the lens increases with an increase in a zenith angle of the lens, and the zenith angle of the lens is an angle between the lens and a normal line of a plane on which the feed source is located.

4. The apparatus according to claim 1, wherein doping densities of the doping medium at different positions of the lens are different.

5. The apparatus according to claim 4, wherein the doping densities of the doping medium decrease with an increase in a zenith angle of the lens, and the zenith angle of the lens is an angle between the lens and a normal line of a plane on which the feed source is located.

6. The apparatus according to claim 1, wherein a shape of the lens is a quasi-rotational symmetric structure or a quasi-translational transformation structure.

7. The apparatus according to claim 1, wherein:

a radian of the inner surface of the lens, a radian of the outer surface of the lens, a thickness of the lens, and a medium doping density in the lens is determined based on a beam sweeping angle of the first beam and a beam sweeping angle of the second beam; or the radian of the inner surface of the lens, the radian of the outer surface of the lens, the thickness of the lens, and the medium doping density in the lens is determined based on a gain of the first beam and a gain of the second beam.

8. The apparatus according to claim 1, wherein a medium layer is disposed on the inner surface of the lens or the outer surface of the lens.

9. The apparatus according to claim 8, wherein a dielectric constant of the lens is $\varepsilon 1$, and a dielectric constant of the medium layer is $\varepsilon 2$, wherein $\varepsilon 2=\sqrt{\varepsilon 1}$, and a thickness of the medium layer is a quarter of a medium wavelength of $\varepsilon 2$.

10. The apparatus according to claim 1, wherein a structure layer is disposed on the inner surface of the lens or the outer surface of the lens.

11. The apparatus according to claim 10, wherein a dielectric constant of a material of the lens is $\varepsilon 1$, and a dielectric constant of the structure layer is $\varepsilon 2$, wherein $\varepsilon 2=\sqrt{\sqrt{\varepsilon 1}}$, and a thickness of the structure layer is a quarter of a medium wavelength of $\varepsilon 2$.

12. The apparatus according to claim 11, wherein a hole is disposed on the structure layer.

13. The apparatus according to claim 12, wherein a depth of the hole is less than or equal to a quarter of a medium wavelength of $\varepsilon 2$.

14. The apparatus according to claim 12, wherein at least two holes are disposed on the structure layer, and a distance between two adjacently disposed holes in the at least two holes is less than or equal to a half of a medium wavelength of $\varepsilon 2$.

15. The apparatus according to claim 1, wherein a hole is disposed on the inner surface of the lens or the outer surface of the lens.

16. The apparatus according to claim 15, wherein a depth of the hole is less than or equal to a quarter of a medium wavelength of $\varepsilon 2$, wherein $\varepsilon 2=\sqrt{\varepsilon 1}$, and $\varepsilon 1$ is a dielectric constant of a material of the lens.

17. The apparatus according to claim 15, wherein at least two holes are disposed on the inner surface of the lens or at least two holes are disposed on the outer surface of the lens, a distance between two adjacently disposed holes is less than or equal to a half of a medium wavelength of $\varepsilon 2$, wherein $\varepsilon 2=\sqrt{\varepsilon 1}$, and $\varepsilon 1$ is the dielectric constant of the material of the lens.

18. The apparatus according to claim 1, wherein a symmetric center of the feed source coincides with a symmetric center of the lens.

19. The apparatus according to claim 1, wherein the feed source comprises an active electronically scanned array.

* * * * *